US005407590A

United States Patent [19]

Salvia

[11] Patent Number: 5,407,590

[45] Date of Patent: Apr. 18, 1995

[54] TRANSITION METAL/POLYMER MATRIX COMPOSITE OF TRANSITION METAL DICHALCOGENIDES AND POLYMERS A LUBRICIOUS AND WEAR RESISTANT COMPOSITE AND METHODS FOR APPLYING SUCH TO SUBSTRATA

[76] Inventor: Vincent F. Salvia, 755 W. Big Beaver Rd., Suite 1315, Troy, Mich. 48084

[21] Appl. No.: 85,179

[22] Filed: Jul. 2, 1993

[51] Int. Cl.[6] ..... C10M 103/06

[52] U.S. Cl. ..... 252/12; 252/12.2; 252/25; 252/58

[58] Field of Search ..... 252/12, 12.2, 25, 58

[56] References Cited

U.S. PATENT DOCUMENTS

| | | | |
|---|---|---|---|
| 3,644,133 | 2/1972 | Nelson | 252/25 |
| 3,678,145 | 7/1972 | Boes | 252/12 |
| 3,808,130 | 4/1974 | Schiefer et al. | 252/12 |
| 3,994,814 | 11/1976 | Cairns | 252/12 |
| 4,052,323 | 10/1977 | Feneberger | 252/23 |
| 4,557,839 | 12/1985 | Tubbs | 252/23 |
| 5,141,656 | 8/1992 | Rountree | 252/25 |

*Primary Examiner*—Jacqueline V. Howard

[57] ABSTRACT

The present invention provides a transition metal/-polymer matrix composite material which has durable, wear and corrosion resistant and friction reducing characteristics which can be used in a powder or liquid form, or, which can be bonded to a desired surface at ambient temperature. The specific components are transition metal dichalcogenides (TMDs) including disulfides, diselenides and ditellurides of Ti, Zr, Hf, V, Nb, Cr, Mo, and W, and polymers including polytetrafuoroethylene (PTFE), hexafluoropropylene, perfluoroalkoxyvinyl ether, ethylenetetrafluoroethylene polymer, polyvinylidene fluoride and ethylenechlorotrifluoroethylene polymer. This invention brings together the unique properties of organic chemistry (PTFE) and inorganic chemistry (TMD's) which creates a synergistic interaction optimizing the friction reducing properties of PTFE with similar friction reducing properties of select TMD's and the TMD's additional wear-resistance and natural tendency for forming a tenacious physical bond at a molecular level. The invention comprises a mixture of PTFE and TMDs (particularly tungsten disulfide and molybdenum disulfide) which can be applied to a substrate through a variety of mechanisms and manners to form a lubricious and wear-resistant layer ranging from 0.5 micron to 60 microns thick.

19 Claims, 2 Drawing Sheets

TRANSITION METAL/POLYMER MATRIX COMPOSITE OF TRANSITION METAL DICHALCOGENIDES AND POLYMERS A LUBRICIOUS AND WEAR RESISTANT COMPOSITE AND METHODS FOR APPLYING SUCH TO SUBSTRATA

FIELD OF THE INVENTION

This invention specifically relates to the unique and unanticipated improvement of characteristics realized through a transition metal/polymer matrix composite consisting of transition metal dichalcogenides (TMDs) (particularly tungsten disulfide, molybdenum disulfide) and polymers (particularly polytetrafuoroethylene (PTFE), regarding their combined beneficial effects upon the lubrication and wear resistance of substrata to which they are applied. In addition, this invention discusses a variety of ways in which this new compound can be applied to substrata.

BACKGROUND OF THE INVENTION

Friction is a significant problem in all mechanical systems and can result in wear, noise, the generation of excess heat and excessive energy consumption. The reduction of friction is an ever growing concern in the transportation based industries because of the presently escalating costs of fuel and the rising consumer demand for reliable, long lasting vehicles. Engines and drive trains include a large number of moving parts and even a small reduction in friction will have a great economic impact upon land, air and sea based transportation. Similarly, friction is a major problem in all industries which manufacture or utilize systems and equipment having moving parts.

Petroleum based lubricants, either in a liquid or solid form, such as oils, greases and the solid form PTFE of are very important in reducing friction in a variety of mechanical systems; however, petroleum based lubricants, relative to TMDs, have low load carrying abilities which limits their effectiveness and their usefulness in high load bearing applications. In some instances systems include precision parts or working environments that would be contaminated by breakdown and outgassing of liquid lubricants.

Dry lubricants have been developed in response to the various shortcomings of liquid lubricants. Dry lubricants generally comprise materials which are fairly inert and which have a lamellar structure which causes them to be lubricous. Among some of the widely utilized dry lubricants are graphite, talc, molybdenum disulfide, tungsten disulfide, niobium disulfide, and boron nitride. Other dry lubricant materials such as ditellurides and diselenides of various group V and VI metals are also employed. In some instances, particles of a lubricous polymer, such as PTFE or other such fluorocarbon polymers, are utilized as dry lubricants. Dry lubricant materials are generally employed in a loose powdered form, or they may be used in combination with a liquid lubricant. Loosely applied lubricant coatings wear away and must be continually renewed. Further, loose particles of lubricant can contaminate a variety of systems.

In response to these shortcomings, various efforts have been made to develop permanent dry lubricant coatings. The term "permanent" as used to describe the lubricant is meant to define a lubricant film which is tightly bonded and integral with the workpiece surface, and is in contrast to lubricant films which are merely disposed upon the surface. In some instances, articles are coated with fluorocarbon polymers so as to provide a highly lubricous surface; however, these coatings are generally soft and have a tendency to migrate off a substrate surface when exposed to pressures.

Various processes have been developed for bonding dry lubricant coatings to the surfaces of various articles. U.S. Pat. Nos. 3,632,368 and 3,644,133 (the disclosures of which are incorporated herein by reference) describe a method for permanently bonding a coating of tungsten disulfide to metallic workpieces. The process disclosed therein uses a modified sandblasting technique wherein atomically clean surfaces are impacted at a fairly high rate of speed with particles of dry lubricant material. This application discloses an impingement bonding technique.

Permanent lubricant materials can confer a significant advantage in terms of improved operating efficiencies and increased lifetime to engines, transmissions and other components of automobiles, airplanes and other motor vehicles.

The present invention is directed toward producing a lubricious wear and corrosion resistant compound adapted to refrain from migrating away from highly loaded contact areas. Use of the present invention enables the production of vehicles as well as processing equipment, tools, and manufacturing equipment which are longer lasting, more energy efficient and more reliable. These and other advantages of the present invention will be readily apparent from the illustrations, discussion and description which follow.

PRIOR ART

It is known to use graphite with alkylene homopolymer or copolymer (Ref. U.S. Pat. No. 4,052,323) as a high temperature lubricant for the purpose of hot-working of metals. This art contains relatively large particle size graphite (100 to 900 microns) and uses an alkylene homopolymer which functions in a different manner from this present invention. Graphite's lubricating characteristics require interaction with water molecules versus the interaction of its internal molecular structure. It does, however, demonstrate another area of synergistic benefit gained through unique organic and inorganic compound combinations.

The development of a synergistic lubricant additive (Ref. U.S. Pat. No. 4,557,839) using molybdenum disulfide mixed with antimony thioantimonate SbSbS4) uses smaller particles of MoS2 (0.1 to about 10 microns), however, this art does not address the unique benefits derived from the TMDs and polymers discussed in this present invention.

The synergistic mixture presented in this invention has not been found in prior art.

SUMMARY OF THE INVENTION

The present invention provides a durable, wear resistant lubricious coating which can be caused to bond to a desired surface and reduce friction, wear and energy consumption. The specific components are TMD's (particularly tungsten disulfide and molybdenum disulfide) and polymers (particularly polytetrafluoroethylene) (PTFE). This invention brings together the unique properties of organic chemistry (PTFE) and inorganic chemistry (TMD's) which creates a synergistic interaction optimizing the friction reducing properties of PTFE with similar friction reducing properties of select TMD's and the TMD's additional wear-resistance and natural tendency for forming a tenacious physical bond at a molecular level. The invention comprises a mixture of PTFE and TMDs (particularly tungsten disulfide and molybdenum disulfide) which can be applied to a substrate through a variety of mechanisms and manners to form a lubricious and wear-resistant layer ranging from 0.5 micron to 60 microns thick.

The compound may include various proportions of PTFE and TMD's to provide a lubricant having various coefficient of friction and material load carrying characteristic properties tailored to specific applications. For example, a mixture of the composite would be prepared for general use—using equal amounts of each component—or "use specific" in which the mixture is formulated to meet specific use requirements, i.e., under lower load needs use a higher percentage of PTFE and where higher load needs exist use a higher percentage of select TMD materials.

In operation, the present invention presents several methods of applying the invention as a permanent, wear-resistant, lubricous coating to a substrate which exists in either a dry or liquid environment.

DRY APPLICATION

The dry application of this invention requires a thorough surface cleaning to the substrate for the deposition of the matrix composite. After surface cleaning preparation is complete there exists a number of ways to depose the invention.

The step of cleaning the workpiece may comprise the steps of providing a liquid based cleaning bath and immersing the workpiece in the cleaning bath. Alternatively, the step of cleaning the workpiece is abrasively cleaned. In some instances, a protective coating may need to be applied to the workpiece concomitant with the step of cleaning to insure the workpiece remains free of contaminants.

Impingement bonding this matrix composite material formed of a mixture of PTFE and select TMDs onto a workpiece allows for a deposition which does not require binders, adhesives or excessive temperatures. More specifically the method includes the steps of: 1) providing at least one workpiece, 2) cleaning the surface of the workpiece to remove substantially all contaminants therefrom impingement bonding the invention as described onto at least a portion of the workpiece, and 3) a mechanical impingement process whereby the workpiece in placed in a rotating container which contains the formulated invention mixture. The mechanical impingement process can be enhanced through the introduction of a material carrying the compound and associated burnishing media.

The invention may be disposed in a stream of carrier gas which is directed onto the workpiece with force sufficient to cause the lubricant to bond to the surface of the workpiece. Sufficient force is provided by pressurizing the gas stream to approximately 30–200 psi. The TMD's selected bind with the PTFE and the new compound forms a tenacious physical bond at the molecular level when such conditions exist. Without the unique combination of this compound the MoS2 and PTFE components would not bind to the substrate surface.

LIQUID APPLICATION

Liquid application of the invention requires first converting the selected dry powder PTFE and TMD selected compound materials into a stabilized colloidal suspension. This is done by those knowledgeable in the art of this process. The invention is readily converted into this format using existing technology that is known to those skilled in the art of creating particle suspension in colloidal solution.

Once the invention is placed in solution it may be introduced into an end product where reduced friction and wear-resistance is desirable. The invention in solution may be added directly or, if desired, may be premixed into another carrier media such as an oil or other type of lubricant or general liquid media. In this form the invention may added to such things as engine crank cases, manual transmissions, rear end differentials, bearing applications or any application desired.

Once entered into a liquid lubricating media, the invention will transmigrate from its suspended colloidal form to become bonded to the working surface of the substrates in comes in contact with. Once bonded it will maintain its friction and wear-resistance protection and work in conjunction with any material which may remain is solution.

These and other objects and aspects of the invention will become apparent in a detailed description of the invention presented hereinafter.

DETAILED DESCRIPTION OF THE INVENTION

There is disclosed a transition metal/polymer matrix composite which is a durable, wear-resistant lubricous material. The material is a composite of PTFE and select TMD's (particularly tungsten disulfide and molybdenum disulfide). The combination of these materials creates an unexpected result when considering the individual characteristics. Individual characteristics are as follows:

Polytetrafuoroethylene (PTFE) is an organic homopolymer from tetrafluoroethylene monomer. It is a linear carbon chain encapsulated within a shroud of flourine atoms. The alignment of the atoms is such that a balance exists between the internal electropositivity and an external electronegativity which yields no net charge difference and contributes to its inert chemical nature. With this molecular structure PTFE exhibits a low coefficient of friction resulting from the weak bond forces between the external positioned flourine atoms and substrates in which they come in contact with. PTFE has a specific gravity of 2.13–2.22, a dynamic coefficient of friction of 0.1 and is a relatively soft material having a hardness rating of 50–65 on the Shore D scale. PTFE is available from the Du Pont Company, Little Falls Centre I, Wilmington, Del. 19880–0810.

The select TMDs used are tungsten disulfide and molybdenum disulfide. These materials are diatomic cross-linked molecular structures which form a lubricous layer. Both materials are naturally inert. The absolute density of tungsten disulfide (WS2) is 7.4 grams per cubic centimeter. Tungsten disulfide is commercially available from sources such as GTE Sylvania of Towanda, Pa. The molecular weight of molybdenum disulfide (MoS2) is 160.06 with a nominal density of 4.96 grams per cubic centimeter. Repurified MoS2 is available from sources such as Climax Molybdenum Corporation, a division of Amex, Inc. of Greenwich, Conn. The crystal structure of both materials is that of a laminar, layer-lattice type, in which a planar layer of tungsten atoms are interspersed between two layers of sulfur atoms. The load carrying capabilities of these TMDs has been measured as high as 300,000 psi.

Although the materials described herein have been used separately and individually as dry film lubricants and in solutions for oils and greases, there has been no invention created that addresses the unique, beneficial characteristics of the materials working in union with each other. WS2 and MoS2 are classified as transition metal dichalcogenides (TMD) which includes the disulfides, diselenides and ditellurides of Ti, Zr, Hf, V, Nb, Cr, Mo and W. These compounds form triagonal prisms with six chalcogen atoms to form the hexagonal type crystal. The beneficial lubricating characteristics of WS2 and MoS2 are related to the layered crystal structures (the large spacing and the weak Van der Waals bonding) between the sandwiched layers. Differences in lubricating behavior among the TMD compounds are attributable to the distribution of electrons on the composing atoms. In WS2 and MoS2, there are six nonbonding electrons available to completely fill the band which physically confines the electrons within the crystal structure. This creates a net positive charge on the surface of the layers which promotes easy shear through electrostatic repulsion.

In PTFE, the carbon atoms are arranged in a linear manner with the flourine atoms totally encapsulating them. As the external charge of the PTFE molecule carries a uniform negative charge which causes low interfacial forces as a result of electrorepulsion. Hence, a lubricating effect occurs because of the ease of shearing between layers of PTFE and between the PTFE and the substrate onto which it is deposited.

This invention creates an improvement over the known benefits and unique characteristics of select TMD's and PTFE, individually, while addressing a limitation in the in the deposition and retention of PTFE on a surface without binders, adhesives and increased temperature.

PTFE as a single dry film lubricant, will not adhere to a substrate and will "migrate" away from even moderately loaded contact areas and lose its effectiveness under extreme pressure working surfaces. The present invention causes the PTFE to be molecularly interlocked within the select TMDs on a substrate surface at the point of contact. The PTFE and TMD molecules are "interlocked" or "driven into" each other during the deposition process. This phenomenon, called intercalation, prevents migration off of the working surface area by the PTFE.

PTFE is a relatively soft material and is unsuited for many tribological applications. Converting PTFE into equivalent load carrying properties yields a maximum of only 120 psi measured at 1200 feet and a velocity of 10 feet per minute. At slightly higher ranges PTFE's load carrying properties reduce to only 2.5 psi at 1000 feet per minute for distance of 2500 feet. Independent laboratory tests demonstrated that the selected TMDs are far superior in the areas of friction and wear under moderate load conditions. (See FIG. 1 and FIG. 2—the PTFE used was Du Pont Company's Teflon TM and the WS2 and MoS2 composite used was Sage Corporation's Tribonite TM. (Sage Corporation is a Michigan corporation with offices located at 755 West Big Beaver Road, Suite 1315, Troy, Mich., 48084.)

The select TMD's WS2 and MoS2 are crystalline structures. When bonded onto a bearing surface these materials will still not cover the surface 100%. Resultant microscopic "pin holes" will expose enough surface so that oxidation may occur as water molecules bond to the exposed surface. The PTFE component of this invention will provide increased effectiveness during the intercalation process and reduce, and conceivably eliminate, the amount of exposed surface which will create an improved or fully corrosion resistant lubricious surface.

The use and application of TMDs, particularly WS2 and MoS2 provides a thin film coating, however, it is difficult to obtain a layer greater than 0.5 to 3 microns. The introduction of PTFE into this compound, through the cross bonding affinity the material has to demonstrated, allows for a process to create a lubricious, wear resistant thin film coating of up 60 microns in a relatively short period of time—as little as 20 minutes in one mechanical application.

This invention allows the lubrication and wear resistant properties of PTFE and TMDs, particularly WS2 and MoS2, to be efficiently realized, providing optimal tribological properties not before experienced. It uniquely combines the beneficial characteristics which exist within the organic and inorganic materials at the molecular and atomic level to create a superior wear resistant, lubricious and corrosion resistant material. The material, in addition, can be readily applied at room temperature without the use of binders or adhesives, or if desired, in a colloidal solution which will allow transfer of the material to the desired substrate during the normal lubrication cycles of engine, gear, or other mechanical, manual or electronic devices.

The invention identifies that it is possible to calibrate a mixture of PTFE and select TMDs to address the specific needs of each and every application. This includes the ability to build a heavier concentration of material when specifications require it using an equal mix of the PTFE and selected TMDs, or to create a thinner coating as required by using a lower ratio of PTFE to the select TMDs used. The range of mix ratios of PTFE and select TMDs, particularly WS2 and MoS2, in the present invention slides along a scale from 00.1:99.9 to 99.9:00.1, depending upon the specific characteristics desired and the environment in which the material is to function. The nominal formulation which is effective for a typical use is equal amounts of the TMDs (particularly tungsten disulfide, molybdenum disulfide) and a polymer (particularly polytetrafluoroethylene). For differing applications the mix ratio is skewed to a higher percentage of PTFE when load carrying and wear resistance needs are lower. For higher load and wear resistance requirements the mix ratio is skewed to a higher percentage of select TMDs. Such broad load, friction and wear resistance ranges have application in aerospace, pharmaceutical, automotive, paper, packaging, food and virtually any other manufacturing or non-service oriented industry.

In many applications high load pressures are normal, such as with components operating within automotive transmissions, rear axles and engine components under vehicle startup and slow traffic conditions. The effects of wear and friction under these high load and low rpm conditions are the most critical versus when a vehicle attains a steady state condition of fixed velocity highway driving. It is under these high load and low rpm conditions which automotive components are under the highest stress and the effects of friction and wear affect not only component life, but fuel economy as well. Under such conditions this invention will constitute a compound with a higher ratio of TMDs versus the PTFE. In this environment, this invention will cause a reduction in frictional horsepower loss which will improve fuel economy, engine performance and vehicle drive train component life.

In other applications, generally light load conditions may be normally encountered. Examples of such low pressure range applications include medical equipment, polymer industry applications—injection molding, ejectors pins, etc.; computer components; pharmaceutical products; food, paper and packaging manufacturing and conveying machinery. For such applications this invention will be calibrated to use a higher ratio of PTFE versus high load requirements. This compound will function as a permanent bonded mold release for the polymer industry which will minimize, and in some cases eliminate, the necessity for the millions of cans of aerosol mold release agent used each year. Limiting the use of such aerosol propellents provides a major benefit, not only to the individual exposed these fumes at the press, but also to the long-term effect on the global environment. The use of this compound in medical equipment will allow quieter and cooler running components in equipment such as X-Ray, CAT-Scan and external heart pumps. The effects of this invention in this industry would provide longer lasting equipment of better quality and higher production capacity. This will contribute to the reduction of health care costs.

TECHNICAL DISCUSSION

Figure 1:
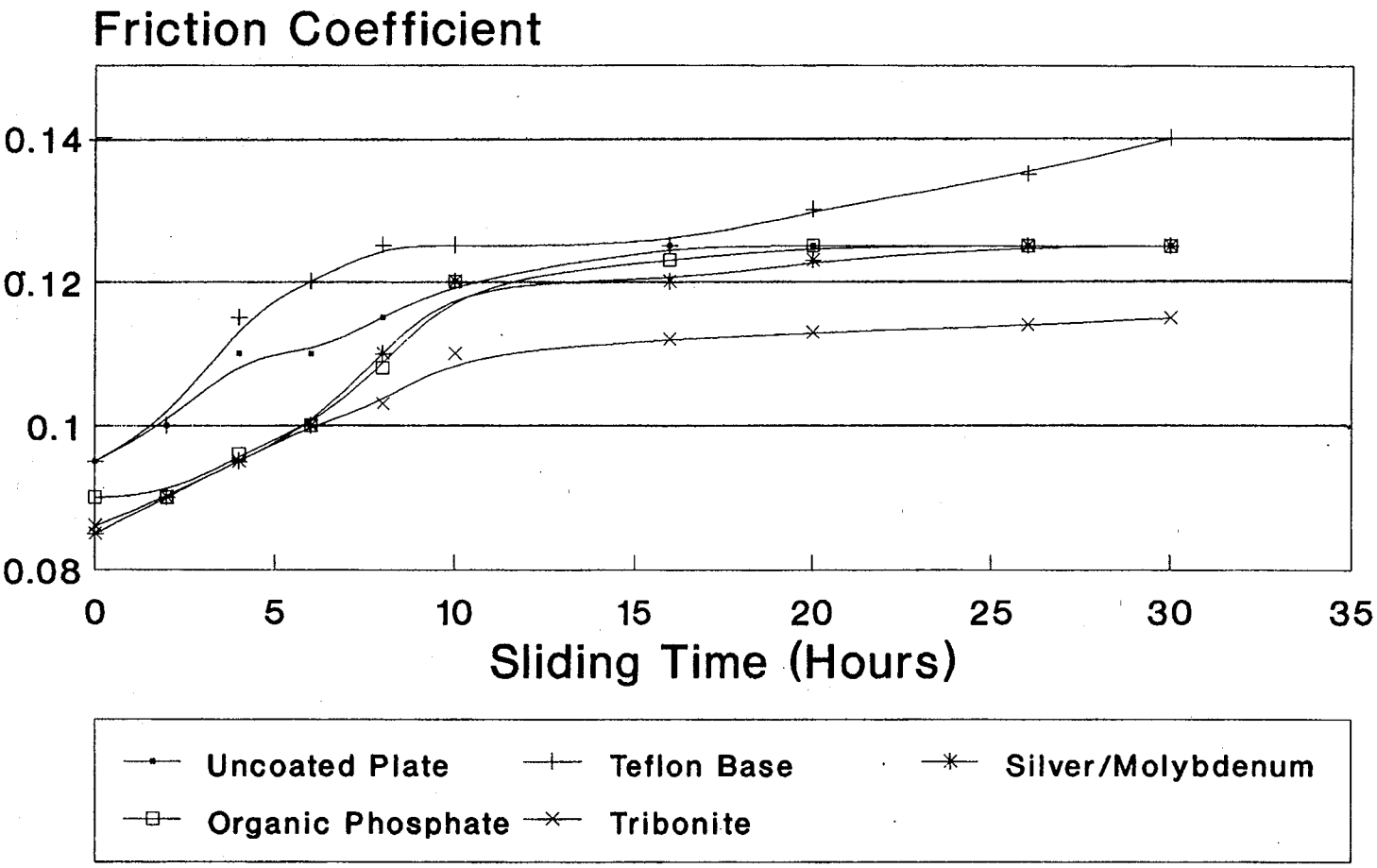
FIG. 1 shows the results of a coefficient of friction test for several thin film coatings.
Figure 2:
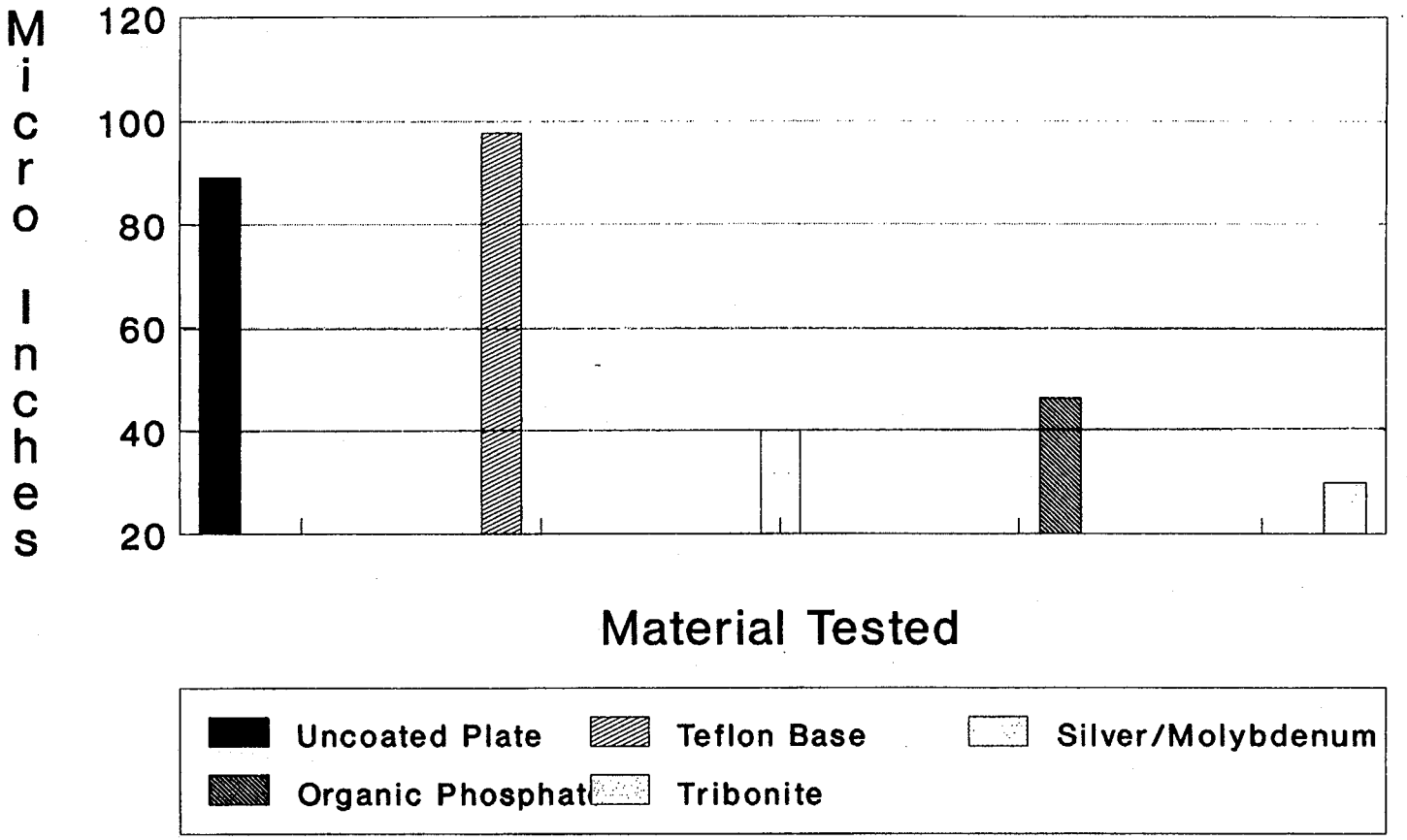
FIG. 2 shows the results the wear test for several thin film coatings tested in FIG. 1.

The effectiveness of this invention results from the unique interaction of transition metal dichalcogenides (particularly tungsten disulfide and molybdenum disulfide) and polymers (particularly PTFE). As presented above, an integral part of the lubricious characteristics of PTFE and the select TMDs is the result of their existing molecular structure and the electronegative repulsion between molecules. Each constituent of this invention exists in a similar size submicron crystalline structure. This relative uniformity allows a synergistic interaction in the matrix composite between the PTFE and the select TMD's WS2 and MoS2. When combined in this invention the weak bonding between the TMDs and the repulsion of PTFE molecules, as a result of their external electronegativity, increases the composites propensity to shear when pressure is applied. This invention promotes easier shear between its components than the individual constituents experience singularly. In addition, there exists the ability for the composite to work as effectively under higher loads as it will under lighter loads. It further appears that this unique interaction creates a dynamic surface friction and wear-resistant reduction environment beginning at a sub-micron level. The electronegative reaction with the combination of this invention's components appear to create an "additive function", that is, the materials combined would tend to have a greater repulsion between themselves than would exist by each singularly. When this invention is applied to a load-carrying surface by any method, such as those presented above, there exists a propensity for the surfaces to repel each other to a greater extent. As a load is applied to this invention the TMD's sandwich layers of tungsten/sulfur and molybdenum/sulfur break loose as a result of the weak Van der Waals bonding between them and they interact with the PTFE electronegative charge of the surrounding flourine atom electrons and gain a slight increase in momentum. This constant interaction occurs on the surface which promotes a dynamic increase in the reduction of friction and improved wear-resistance rather than the normal static form of friction reduction that exists with the PTFE or select TMDs, particularly WS2 and MoS2, alone.

Having thus described my invention, it can be seen that various alternative embodiments of the invention can be envisioned without departing from the scope of the invention as defined in the following claims.

I now claim:

1. A transition metal/polymer matrix composite material consisting of tungsten disulfide, molybdenum disulfide and polytetrafuoroethylene in which a synergistic reaction between the tungsten disulfide, molybdenum disulfide and polytetrafuoroethylene create a lubricious and wear-resistant layer between bearing surfaces which promotes easier shear under pressure than the individual constituents because of interaction of the weak bonding in the tungsten disulfide and molybdenum disulfide structure and the external electronegativity of the polytetrafuoroethylene.

2. A transition metal/polymer matrix composite material of claim 1, wherein said mixture includes approximately equal amounts of tungsten disulfide, molybdenum disulfide and polytetrafuoroethylene.

3. A transition metal/polymer matrix composite material of claim 1, wherein said mixture includes a greater amount of tungsten disulfide and molybdenum disulfide than polytetrafuoroethylene.

4. A transition metal/polymer matrix composite material of claim 1, wherein said mixture includes at least 75 percent tungsten disulfide, and molybdenum disulfide.

5. A transition metal/polymer matrix composite material of claim 1, wherein said mixture includes a greater amount of polytetrafluoroethylene than of tungsten disulfide or molybdenum disulfide.

6. A transition metal/polymer matrix composite material of claim 1, wherein said mixture includes at least 75 percent of polytetrafluoroethylene.

7. A method of applying the transition metal/-polymer matrix composite material of claims 1 through 6 to a workpiece wherein said method includes a step of air impingement bonding the powder form of the material to a workpiece using a dry air conveyance so that the tungsten disulfide bonding affinity provides a permanently bonded molecular interlocking mechanism which causes the molybdenum disulfide and polytetrafuoroethylene to refrain from migrating off the bearing surface.

8. A method of applying a transition metal/polymer matrix composite material of claim 7 to a workpiece, said method including the steps of:

providing at least one workpiece;

cleaning the surface of said at least one workpiece to remove substantially all contaminants therefrom; and impingement bonding a transition metal/polymer matrix composite material at least one workpiece.

9. A method as in claim 8, wherein the step of impingement bonding a transition metal/polymer matrix composite material of claims 1 through 6 onto at least a portion of a workpiece comprises disposing of said composite material in a stream of carrier gas and directing this stream of gas onto at least one workpiece with sufficient force so as to cause said composite material to bond to the surface of said workpiece.

10. A method as in claim 9, including the further step of pressurizing said gas stream to approximately 30–200 psi.

11. A method of applying a transition metal/polymer matrix composite material of claims 1 through 6 consisting of tungsten disulfide, molybdenum disulfide and polytetrafuoroethylene to a substrate, wherein said method includes a mechanical burnishing process in a rotating container which creates a soft bond of the material to bearing surfaces which are exposed to dry, low pressure environments, and which is readily and economically adaptable to large volume applications.

12. A method of applying a transition metal/polymer matrix composite material of claims 1 through 6 consisting of tungsten disulfide, molybdenum disulfide and polytetrafuoroethylene to a substrate, wherein said method includes the step of a mechanical impingement process whereby the workpiece and composite material are placed in a rotating container which contains an additional compound or associated burnishing media.

13. A method of presenting a transition metal/-polymer matrix composite material of claims 1 to 6 consisting of tungsten disulfide, molybdenum disulfide and polytetrafuoroethylene to a substrate in a liquid environment by converting the material into a colloidal dispersion and introducing this solution into the environment and/or mechanism desired.

14. A method of applying a transition metal/polymer matrix composite material of claims 1 to 6 consisting of tungsten disulfide, molybdenum disulfide and polytetrafuoroethylene to a substrate in a liquid environment by converting the material into a colloidal dispersion and premixing this solution with another carrier media, such as oil or other type of liquid, and introducing this solution into the environment and/or mechanism desired.

15. A method as in claim 8, wherein the step of impingement bonding a transition metal/polymer matrix composite material formed from tungsten disulfide, molybdenum disulfide and polytetrafuoroethylene comprises the step of impingement bonding a composite material formed from approximately equal amounts of tungsten disulfide, molybdenum disulfide and polytetrafuoroethylene.

16. A method as in claim 8 wherein the step of impingement bonding a dry lubricant formed from a mixture of tungsten disulfide, molybdenum disulfide and polytetrafuoroethylene comprises the step of impingement bonding a dry lubricant formed from a greater amount of tungsten disulfide and molybdenum disulfide than polytetrafluoroethylene.

17. A method as in claim 8, wherein the step of impingement bonding a transition metal/polymer matrix composite material formed from a mixture of tungsten disulfide, molybdenum disulfide and polytetrafuoroethylene comprises the step of impingement bonding the composite material approximately of at least 75 percent tungsten disulfide and molybdenum disulfide.

18. A method as in claim 8, wherein the step of impingement bonding a transition metal/polymer matrix composite material formed from a mixture of tungsten disulfide, molybdenum disulfide and polytetrafuoroethylene comprises the step of impingement bonding a dry lubricant formed from a greater amount polytetrafluoroethylene than tungsten disulfide and molybdenum disulfide.

19. A method as in claim 8, wherein the step of impingement bonding a transition metal/polymer matrix composite material consisting of tungsten disulfide, molybdenum disulfide and polytetrafuoroethylene comprises the step of impingement bonding formed from at least 75 percent of polytetrafluoroethylene.

* * * * *